US010619467B2

(12) United States Patent
Haci

(10) Patent No.: US 10,619,467 B2
(45) Date of Patent: Apr. 14, 2020

(54) SYSTEMS AND METHODS FOR RECOVERING BITUMEN FROM SUBTERRANEAN FORMATIONS

(71) Applicant: MUST HOLDING LLC, Houston, TX (US)

(72) Inventor: Marc Haci, Houston, TX (US)

(73) Assignee: MUST HOLDING LLC, Houston, TX (US)

( * ) Notice: Subject to any disclaimer, the term of this patent is extended or adjusted under 35 U.S.C. 154(b) by 0 days.

(21) Appl. No.: 16/188,183

(22) Filed: Nov. 12, 2018

(65) Prior Publication Data

US 2019/0078423 A1 Mar. 14, 2019

Related U.S. Application Data

(62) Division of application No. 15/199,974, filed on Jun. 30, 2016, now Pat. No. 10,125,588.

(51) Int. Cl.

| | |
|---|---|
| ***E21B 43/24*** | (2006.01) |
| ***E21B 43/16*** | (2006.01) |
| ***E21B 43/12*** | (2006.01) |
| *E21B 47/06* | (2012.01) |

(52) U.S. Cl.

CPC ..... *E21B 43/2401* (2013.01); *E21B 43/121* (2013.01); *E21B 43/168* (2013.01); *E21B 43/24* (2013.01); *E21B 47/06* (2013.01); *E21B 47/065* (2013.01)

(58) Field of Classification Search

CPC .... E21B 43/2401; E21B 43/24; E21B 43/168; E21B 43/12; E21B 47/065; E21B 47/06

See application file for complete search history.

(56) References Cited

U.S. PATENT DOCUMENTS

| | | | | |
|---|---|---|---|---|
| 4,679,637 | A | 7/1987 | Cherrington et al. | |
| 8,267,185 | B2 * | 9/2012 | Ocampos | E21B 43/2401 166/387 |
| 8,327,932 | B2 | 12/2012 | Karanikas et al. | |
| 9,309,755 | B2 | 4/2016 | Gonzales et al. | |

(Continued)

OTHER PUBLICATIONS

Energy Trends Insider; The Cost of Production and Energy Return of Oil Sands; by Robert Rapier; Dec. 9, 2013; www.energytrendsinsider.com/2013/12/09/the-cost-of-production-and-energy-return-of-oil-sands/).

(Continued)

*Primary Examiner* — Michael R Wills, III

(74) *Attorney, Agent, or Firm* — Halit N. Yakupoglu

(57) ABSTRACT

A well system for recovering hydrocarbons such as heavy crude oil from subsurface reservoirs is provided. The well system includes a single continuous wellbore extending from a surface entry opening to a surface exit opening. A substantially horizontal section of the wellbore is formed within the subsurface reservoir. In one embodiment, a plurality of heater-lifter units are movably disposed within the substantially horizontal wellbore section. The heater-lifter units are configured to apply heat to subsurface reservoir surrounding the substantially horizontal wellbore section to mobilize the hydrocarbons. A lifting mechanism is configured to move the heater-lifter units in bidirectional manner within the continuous wellbore so that the produced low viscosity hydrocarbons are mechanically lifted to the surface.

20 Claims, 8 Drawing Sheets

(56) References Cited

U.S. PATENT DOCUMENTS

| | | | | |
|---|---|---|---|---|
| 2007/0284108 | A1 | 12/2007 | Roes et al. | |
| 2009/0071652 | A1* | 3/2009 | Vinegar | E21B 36/04 166/303 |
| 2010/0089584 | A1 | 4/2010 | Burns | |
| 2011/0247808 | A1 | 10/2011 | Nguyen | |
| 2014/0190691 | A1 | 7/2014 | Vinegar et al. | |
| 2017/0275979 | A1 | 9/2017 | Chalifoux | |

OTHER PUBLICATIONS

PetroWiki; Compositional effects during immiscible gas injection; SPE International; Jun. 8, 2015; (petrowiki.org/Compositional_effects_during_immiscible_gas_injection).

* cited by examiner

SYSTEMS AND METHODS FOR RECOVERING BITUMEN FROM SUBTERRANEAN FORMATIONS

RELATED APPLICATION

This application is a divisional of U.S. patent application Ser. No. 15/199,974, filed on Jun. 30, 2016, the entire disclosure of which is incorporated herein by reference.

BACKGROUND

Field of the Invention

The present invention relates generally to recovery of petroleum crude oil from subterranean hydrocarbon reservoirs and, more particularly, to systems and methods for in-situ recovery of petroleum crude oil or bitumen from deposits of sand and shale.

Description of the Related Art

Steam Assisted Gravity Drainage (SAGD) is one of the techniques for recovering tar-sand based high viscosity hydrocarbons or heavy oil, or commonly known as crude oil or bitumen, from subsurface geologic formations or reservoirs. The high viscosity of the crude oil or bitumen, which can exceed $10^6$ centipoise, prevents it from flowing at natural reservoir temperatures; therefore, the bitumen deposits cannot be economically exploited by traditional oil well recovery technologies.

As shown in the example in FIG. 1, in conventional SAGD techniques, at least two parallel horizontal wellbores 11A and 11B can be drilled in a crude oil bearing formation 10, one approximately 5 meters above the other. The SAGD processes generally includes heating the high viscosity crude oil through the upper wellbore 11A by continuously injecting steam 12 into it so that the steam, possibly mixed with solvents, forms a steam chamber in the formation.

The heat from the continuously injected steam reduces the viscosity of the high crude oil and thus improves its mobility. The lower wellbore 11B collects the heated low viscosity crude oil that flows out of the formation, along with any water from the condensation of injected steam. The fluid mixture 14 entering the lower wellbore 11B is then pumped to the surface 16 for refining and oil production.

However, the SAGD techniques exhibit various problems that affect productivity and efficiency. In addition to the cost of drilling well pairs, steam generation and the associated emissions are major concerns in assessing the economic potential of such recovery operations.

One major problem is the requirement for large amounts of energy to produce the steam and hence deliver sufficient heat to stimulate the heavy oil bearing reservoir. Such required large amounts of energy is usually obtained by burning natural gas which is often available in the tar-sand fields, which also generates unwanted gas emissions, particularly carbon dioxide emissions causing environmental pollution. Furthermore, difficulties in maintaining or controlling the temperature of the crude oil during the extraction can also pose difficulties.

From the foregoing, therefore, there is a need for a novel system and a method, which overcomes the many disadvantages of the conventional heavy crude oil recovery technologies, for efficiently mobilizing and recovering a significant amount of crude oil from subsurface heavy crude oil reservoirs.

SUMMARY

An aspect of the present invention includes a system for recovering hydrocarbons from a subsurface reservoir, comprising a continuous wellbore extending from a first surface location to a second surface location, the continuous wellbore including a first inclined wellbore section extending from the first surface location to the subsurface reservoir, a substantially horizontal wellbore section lying within the subsurface reservoir, and a second inclined wellbore section extending from the subsurface reservoir to the second surface location; a plurality of heater-lifter units disposed within the substantially horizontal wellbore section, the heater-lifter units being configured to apply heat to the subsurface reservoir to produce a hydrocarbon fluid and to sweep the hydrocarbon fluid along a direction of motion of the heater-lifter units to mechanically lift the hydrocarbon fluid to the first surface location and the second surface location; a carrier line carrying the heater-lifter units in a spaced apart fashion, the carrier line extends through the continuous wellbore and between the first and second surface locations; and a lifting mechanism configured to move the carrier line and thus the heater-lifter units coupled to the carrier line in bidirectional manner in the continuous wellbore to mechanically lift the hydrocarbon fluid to the first surface location and the second surface location by sweeping the hydrocarbon fluid through the continuous wellbore with the heater-lifter units.

Another aspect of the present invention includes a method for recovering hydrocarbons from a subsurface hydrocarbon reservoir, comprising forming a first inclined wellbore section of a continuous wellbore by drilling from a wellbore entry location at the surface to the subsurface hydrocarbon reservoir; forming a substantially horizontal wellbore section of the continuous wellbore after deviating an end of the first inclined wellbore section and then drilling until an end of the substantially horizontal wellbore section, the substantially horizontal wellbore section lying within the subsurface hydrocarbon reservoir; forming a second inclined wellbore section of the continuous wellbore after deviating the end of the substantially horizontal wellbore section and then drilling until a wellbore exit location at the surface; applying heat to a portion of the subsurface reservoir surrounding the substantially horizontal wellbore section from a plurality of heater-lifter units movably disposed within the substantially horizontal wellbore section; producing hydrocarbon fluids flowing into the substantially horizontal wellbore section from the portion of the subsurface reservoir; and moving the heater-lifter units in bidirectional manner within the continuous wellbore to mechanically lift the hydrocarbon fluids to the wellbore entry location and the wellbore exit location by sweeping the hydrocarbons fluids with bidirectional motion of the heater-lifter units.

Another aspect of the present invention includes an apparatus for heating a subsurface hydrocarbon reservoir surrounding a substantially horizontal perforated section of a cased continuous wellbore extending between a first ground surface opening and a second ground surface opening and recovering the hydrocarbon products released thereby, comprising a plurality of heater-lifter units movably disposed within the substantially horizontal perforated section of the cased continuous wellbore, each heater-lifter unit comprising, an elongated housing defined by a cylindrical peripheral wall facing the inner surface of the substantially horizontal wellbore section and two end-walls sealing the ends of the elongated housing, a plurality of heating members protrude outwardly from the cylindrical peripheral wall, the heating members being configured to heat the subsurface hydrocarbon reservoir to produce hydrocarbon fluids which fill the substantially horizontal wellbore section, and a plurality of flexible sweeping members protruding outwardly from the cylindrical peripheral wall of the heater units, the flexible sweeping members being configured to sweep and carry the hydrocarbon fluids along the direction of motion of the heater-lifter units, a carrier line configured to carry the plurality of heater-lifter units in a spaced apart fashion within the continuous wellbore and include electrical power and data lines connecting the heater-lifter units to a surface power and control center; and a lifting mechanism configured to move the carrier line in bidirectional manner to mechanically lift the hydrocarbon fluids to the first ground surface opening and the second ground surface opening by sweeping the hydrocarbon fluid through the continuous wellbore with bidirectional motion of the heater-lifter units.

Yet another aspect of the present invention includes a system for recovering hydrocarbons from a subsurface reservoir, comprising a continuous wellbore extending from a first surface location to a second surface location, the continuous wellbore including a first inclined wellbore section extending from the first surface location to the subsurface reservoir, a substantially horizontal wellbore section lying within the subsurface reservoir, and a second inclined wellbore section extending from the subsurface reservoir to the second surface location; and a pressured gas assembly configured to supply a flow of pressured gas into the continuous wellbore from the first surface location so as to apply pressured gas to the subsurface reservoir surrounding the substantially horizontal wellbore section to produce a hydrocarbon fluid and to flow the hydrocarbon fluid along a direction of the flow of pressured gas to the second surface location.

BRIEF DESCRIPTION OF THE DRAWINGS

These and other aspects and features of the present invention will become apparent to those of ordinary skill in the art upon review of the following description of specific embodiments of the invention in conjunction with the accompanying figures, wherein.

DETAILED DESCRIPTION OF THE PREFERRED EMBODIMENTS

Figure 1:
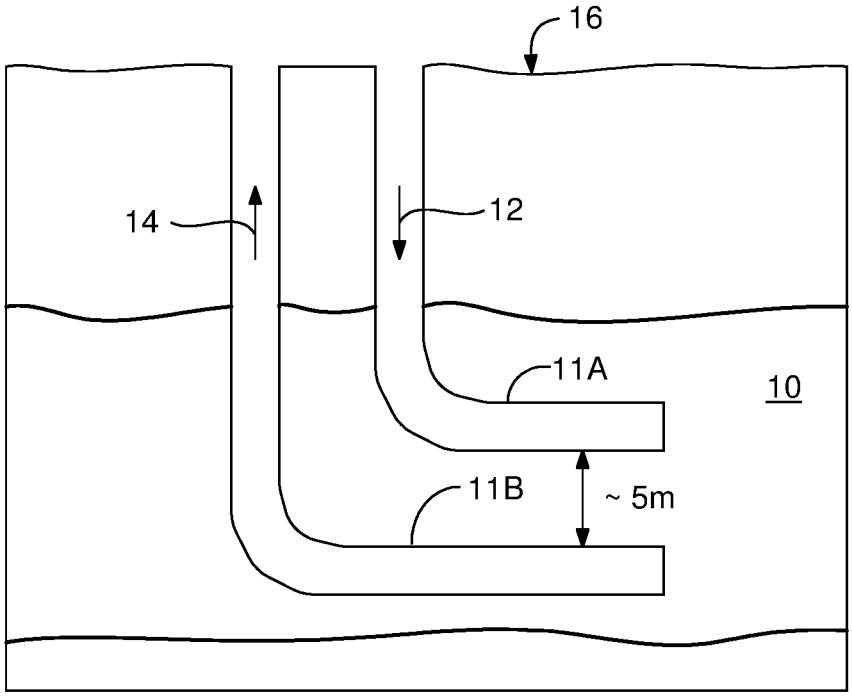
FIG. 1 (PRIOR ART)
FIG. 1 is a schematic view of a prior art double well system.

The present invention provides embodiments of a well system and a method for recovering high viscosity hydrocarbon materials, such as bitumen, heavy oil or heavy crude oil, from subterranean or subsurface oil formations by treating the hydrocarbon material in-situ in the reservoir to reduce its viscosity and subsequently lifting the low viscosity hydrocarbon material to the surface. Bitumen or heavy crude oil contained in subsurface sand tars or oil sands is semi-solid and immobile in subsurface reservoir conditions and does not flow unless its viscosity is reduced. Such subsurface reservoirs may be under an overburden earth layer with no economic value, which cannot be recovered by traditional surface mining methods using for example excavation methods.

In one embodiment, in order to access a high economic value subsurface hydrocarbon material deposit, the present invention initially forms a continuous wellbore drilled from the surface down to and across a hydrocarbon material bearing reservoir and back up to the surface. The continuous wellbore may extend from a surface entry opening to a surface exit opening by following an underground path to cross the subsurface reservoir, i.e. a subterranean oil formation containing the hydrocarbon material.

The continuous wellbore of the present invention may be a single wellbore having a wellbore path changing direction under predetermined angles to reach the subsurface reservoir from a surface access location, extend through the subsurface reservoir and leave the subsurface reservoir to reach another surface access location.

The continuous wellbore may include a first wellbore section, a second wellbore section including perforations and a third wellbore section. The first wellbore section of the continuous wellbore may extend downwardly from the ground surface entry opening and penetrates into the subsurface reservoir containing the hydrocarbon material, establishing a first access path to the subsurface reservoir from the surface. Within the subsurface reservoir, the second wellbore section, where the hydrocarbon production occurs, may extend substantially horizontally, i.e., about perpendicular to the axis of gravitation, from the lower end of the first wellbore section to a predetermined distal end of the second wellbore section. Finally, the third wellbore section of the continuous wellbore may extend upwardly from the distal end of the second wellbore section to the ground surface exit opening, providing a second access path to the subsurface reservoir from the surface. This single continuous wellbore may be formed using directional drilling techniques in a single drilling operation.

In one embodiment, a dual function apparatus of the present invention may be used to extract the hydrocarbon material by first heating the hydrocarbon material and then mechanical lifting it to the surface. This dual function apparatus will be called heater-lifter unit hereinafter.

A heater-lifter module including a plurality of heater-lifter units, or heater-sweeper units, may be disposed within the substantially horizontal second wellbore section to perform two functions: first, to deliver in-situ heat to the hydrocarbon material to flow it into the second wellbore section, and, second, to sweep the low viscosity hydrocarbon material from the second wellbore section to the surface. In order to perform these two functions, each heater-lifter unit may include a plurality of heating members and a plurality of sweeping members distributed radially over the outer surfaces of the heater-lifter units. The heating members of the heater-lifter units may be configured to apply heat to the portion of the reservoir adjacent the substantially horizontal second wellbore section so as to reduce the viscosity of the hydrocarbon material contained therein. As the viscosity of the hydrocarbon material is reduced, the hydrocarbon material may transform into a hydrocarbon fluid which flows into the substantially horizontal second wellbore section through the perforations therein.

A carrier system including a carrier line may be configured to carry and support the heater-lifter units of the heater module in a spaced apart fashion. The carrier line may extend through the continuous wellbore and between the entry opening and the exit opening. A moving mechanism may be configured to move the carrier line and thus the heater-lifter units throughout the continuous wellbore toward either the entry opening or the exit opening so that the collected hydrocarbon fluid is recovered and brought to the surface through the entry and exit openings with the sweeping action of the sweeping members on the heater-lifter units. In order to increase the recovery efficiency the heater-lifter units may be moved in a bidirectional manner, the moving mechanism may move the heater-lifter units first toward one of the surface openings to deliver the collected hydrocarbon fluid to the surface after a first heating step, and then toward the other surface opening after a second heating step to deliver the collected hydrocarbon fluid to the surface.

The present invention may provide several advantages over prior art systems. Firstly, the system of the present invention may include only one wellbore extending between two ground surface locations, as opposed to, for example, the prior art's two well SAGD systems. Secondly, in one embodiment, the heater-lifter units may generate heat downhole and in-situ within the oil bearing reservoir. This may avoid cooling and condensation problems of the steam using SAGD systems, which pump steam into well from the surface. The present invention may also use limited amounts of power which lowers unwanted atmospheric emissions and the production cost.

Furthermore, the present invention may advantageously provide mechanical lifting of the extracted hydrocarbon material from the lowest depth of the continuous wellbore by being able to move the heater-lifter units toward both well heads at the entry opening and the exit opening. In typical SAGD technologies, the reduced viscosity hydrocarbon material in the wellbore is recovered using a pump which is lowered down to a location where the curved section of the wellbore between the vertical and horizontal portions begins. The pump may not be placed into the horizontal portion of SAGD wellbores because of the wellbore's near L shaped design. The system of the present invention also makes the repair operations much simplified when they are needed because the wellbore is accessible from two surface locations.

Figure 2A:
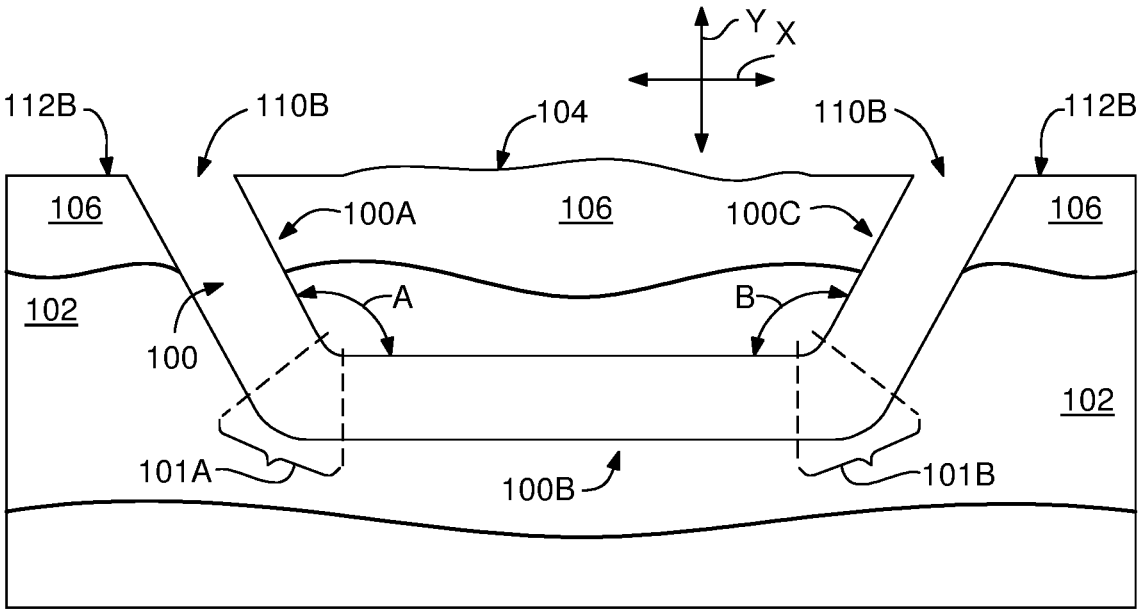
FIG. 2A is a schematic view of an embodiment of a continuous wellbore formed using directional drilling methods to access a subsurface hydrocarbon reservoir from two surface locations.

Referring now to FIG. 2A, there is shown a continuous wellbore 100 for accessing a subterranean formation 102, or subsurface zone or reservoir, which may be a geological formation containing a hydrocarbon material such as bitumen, heavy oil or crude oil in one embodiment. The hydrocarbon material may have a viscosity in the range of 200,000 to 2 million centipoise (cP) at reservoir temperatures, which may be typically 5-15° C. At this high viscosity range the hydrocarbon material cannot naturally flow. In one embodiment, a goal of the process of the present invention is to thermally reduce the viscosity of the hydrocarbon material to a viscosity range of about 10-50 cP, preferably 10-20 cP, by increasing the temperature of the hydrocarbon material. The subterranean formation 102 may be located several hundred meters below the surface 104 of the ground, about 100 to 500 meters (m), and hence under an overburden layer of the earth. In accordance with the principles of the present invention, the continuous wellbore 100 may generally include a single wellbore extending between a first opening 110A or an entry opening at an entry location 112A at the surface 104 and a second opening 110B or an exit opening at an exit location 112B at the surface 104. The curved path of the continuous wellbore 100 may enable a mid portion of the continuous wellbore to extend within the subterranean formation 102, which mid portion may be advantageously accessed from both the first opening 110A and the second opening 110B of the continuous wellbore 100.

The distance between the entry location 112A and the exit location 112B may be in the range of about 500 meters to about 5 kilometers. The continuous wellbore 100 may generally include three sections, namely, a first wellbore section 100A, a second wellbore section 100B and a third wellbore section 100C. In one embodiment, the second wellbore section 100B of the continuous wellbore 100 may be extended along a substantially straight path within the subterranean formation 102 containing the hydrocarbon material. Furthermore, the second wellbore section 100B may be substantially horizontal with respect to the first and third wellbore sections 100A and 100C. The second wellbore section 100B may be along an X-axis which may be perpendicular to the gravitational axis depicted as Y-axis in FIG. 2A. The first and third wellbore sections 100A and 100C may penetrate into the subterranean formation 102 from the surface 104 by crossing the overburden 106 between the surface 104 and the subterranean formation 102. Both the first wellbore section 100A and the third wellbore section 100C may include straight sections and may be slanted with respect to the second wellbore section 100B. As such, a first angle '$A_1$' between the first wellbore section 100A and the second wellbore section 100B as well as a second angle '$A_2$' between the third wellbore section 100C and the second wellbore section 100B may be in the range of about 100-160 degrees. In this respect, the first and second angles $A_1$ and $A_2$ may be different angles or the same. In this embodiment, the first and second angles $A_1$ and $A_2$ may be the same angles.

In one embodiment, the continuous wellbore 100 (the wellbore 100 hereinafter) may be drilled in a single drilling operation using three consecutive stages to form each section of the wellbore 100. The drilling operation may be, for example, performed using a rotary drilling system including a drill string and a drill bit to form the wellbore 100 of the present invention. Accordingly, at a first stage, the first wellbore section 100A may be formed extending downwardly from the entry opening 110A and penetrating into the subterranean formation 102 under a suitable angle for a predetermined distance. Within the subterranean formation 102, the wellbore 100 may be gradually deviated while drilling until the first angle $A_1$ is obtained, which deviation action results in a first elbow section 101A or first curved section. The length of the first elbow section 101A may be in the range of about 50-200 meters.

Once the deviation operation is completed, at a second stage, the wellbore 100 may be further extended by forming the second wellbore section 100B to exploit the subterranean formation 102. As described above, the second wellbore section 100B may be substantially horizontal. Once a desired length is reached for the second wellbore section 100B, the wellbore 100 may be gradually deviated, this time, in an upward direction towards the surface 104 while drilling until the second angle $A_2$ is obtained. This second deviation action results in a second elbow section 101B or a second curved section. The length of the second elbow section 101B may also be in the range of about 50-200 meters. Once the second deviation operation is completed, at a third stage, the wellbore 100 may be yet further extended by forming the third wellbore section 100C which exits the surface 104 at the exit opening 110B.

Depending on the depth and length of the subterranean formation 102, the first and third wellbore sections 100A and 100C may have a length in the range of about 100-600 m. The second wellbore section 100B may have a length in the range of about 500-5000 m, preferably about 1000-2000 m. The second wellbore 100B section may be located at a depth in the range of about 100-500 m. The length of the first and second elbow sections 101A and 101B may be in the range of about 50-200 meters. A curving rate of the first and second elbow sections may be between about 5 degrees per 30 m (5°/30 m) and about 20 degrees per 30 m (20°/30 m), preferably between about 8 degrees per 30 m (8°/30 m) and about 15 degrees per 30 m (15°/30 m).

It will be appreciated that in this embodiment an exemplary single curved path of the wellbore 100 shown in FIG. 2A may be formed by deviation of the straight wellbore sections while drilling the wellbore 100. However, the entire wellbore 100 may be formed along a single arcuate path (a bow like path), i.e., penetrating from the subterranean formation along a downward curved path section, continuing the curved path within subterranean formation and exiting the surface with an upward curved path section, and this aspect is within the scope of this invention. In an alternative embodiment, the wellbore 100 may be drilled using two or more drilling operations. For example, a first drilling operation step may be performed to form the first wellbore section and then the second wellbore section may be formed by deviating the first wellbore; and, a second drilling operation step may be performed to drill the third wellbore section from the surface towards the subterranean formation to directly meet and get connected to the second well bore section, or to form at least a portion of the second well bore section before getting connected to the other portion of the second wellbore section formed during the first drilling operation step.

Figure 2B:
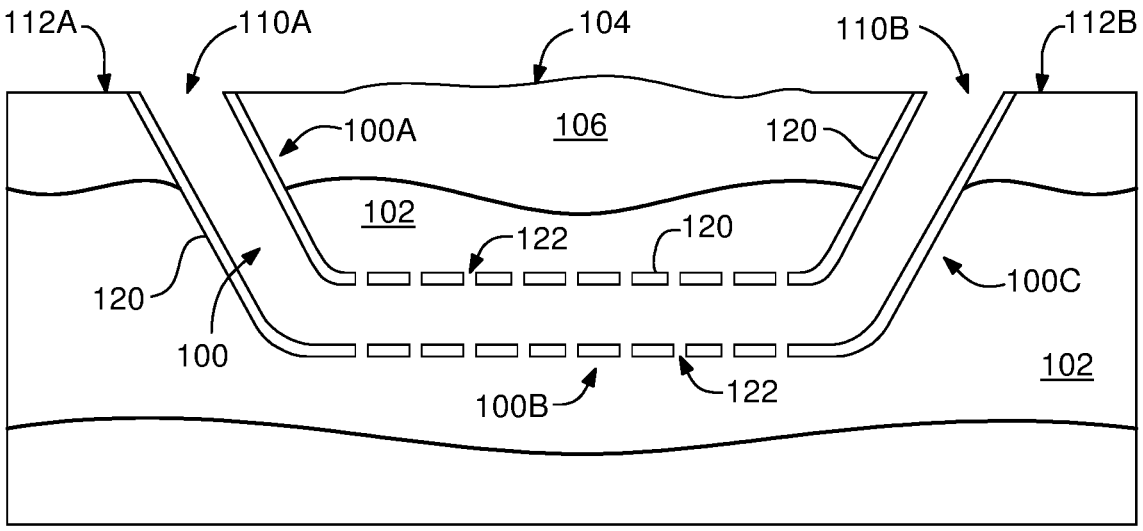
FIG. 2B is a schematic view of the continuous wellbore shown in FIG. 2A, wherein the continuous wellbore has been cased.

Referring now to FIG. 2B, after the drilling operation is completed, a casing 120 may be pulled and reamed into the wellbore 100 and the wellbore 100 is cased with metallic tubing, for example steel tubing. The casing 120 extending through the wellbore 100 may be cemented into position in the wellbore and secured. In some embodiments, portions of the casing 120 extending within the first wellbore section 100A and the third wellbore section 100C may be made of casing materials having less thermal conductivity than the thermal conductivity of the casing material forming the portion of the casing 120 extending through the second wellbore section 100B. As will be described more fully below, using a higher thermal conductivity casing material for the second wellbore section 100A may provide faster and higher heat transfer to the subterranean formation 102 surrounding the second wellbore section 100B. Thermal conductivity may be for example varied by alloying of the casing material and/or coating inner and/or outer surfaces of the casing tube higher or lower thermal conductivity material layers.

After casing the wellbore 100, the entire length or a predetermined length of the second wellbore section 100B may be perforated using a perforation gun, thereby providing a multiplicity of perforations 122, i.e., holes or slots, which may be distributed along the entire length of the second wellbore section 100B which is substantially horizontal. Alternatively, the perforations 122 may be made in the tubes before the casing step, thus not requiring cementing and perforation forming operations. The perforations 122 define openings in the casing 120 and in the cement layer located between the casing 120 and the subterranean formation 102 and thereby provide communication with thousands of square meters of subterranean formation 102 including the hydrocarbon material such as bitumen. The cement layer which may surround the casing 120 in one embodiment is not shown in FIGS. 2B-3C for clarity; however, it can be seen in FIG. 7. The outer diameter of the casing 120 may be between about 4½ inches to 10¾ inches.

Figure 3A:
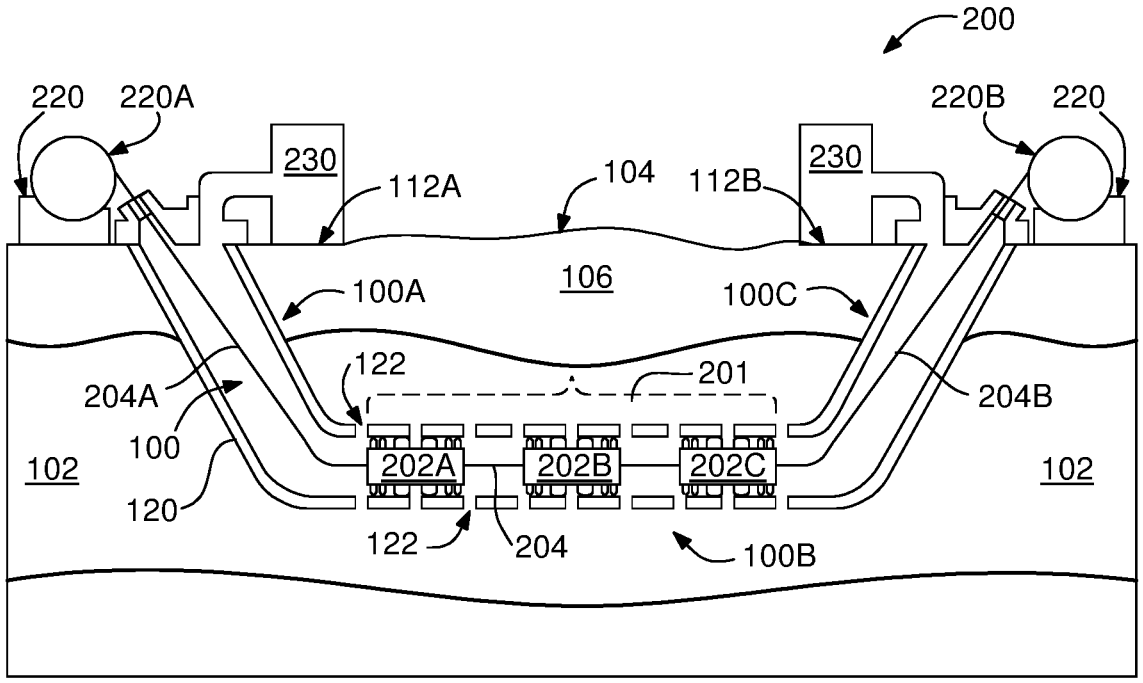
FIG. 3A is a schematic view of an embodiment of a system of the present invention including a heater-lifter module disposed within the continuous wellbore for mobilizing hydrocarbons in the subsurface hydrocarbon reservoir by thermal treatment.
Figure 3B:
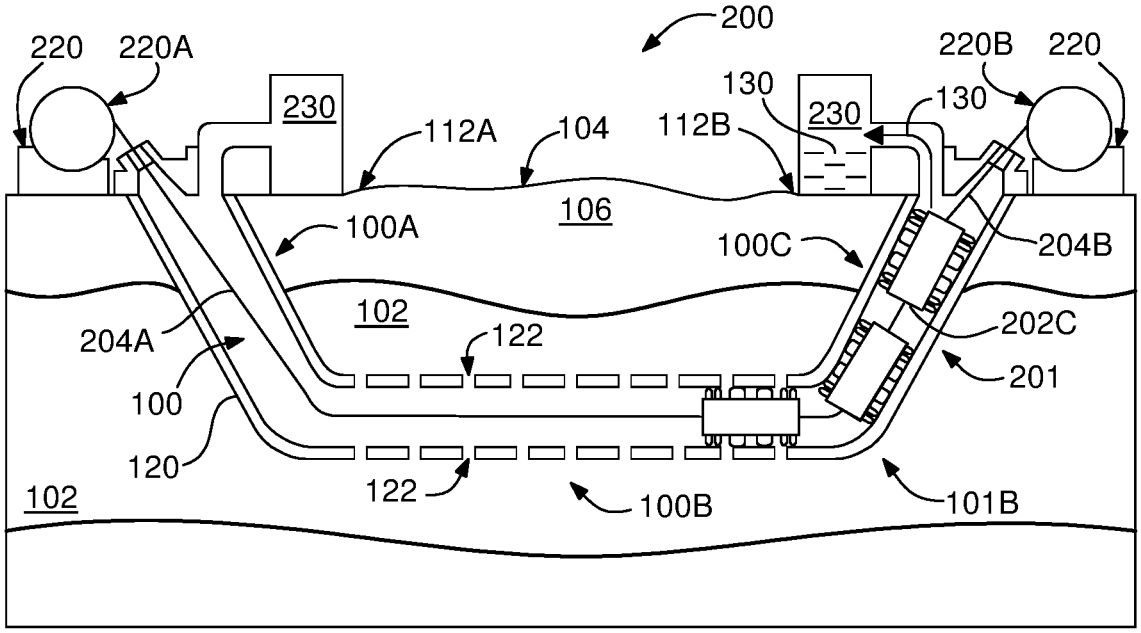
FIGS. 3B-3C are schematic views of the system shown in FIG. 3A including a lifting mechanism operating the heater-lifter module within the continuous wellbore to recover the mobilized hydrocarbons.
Figure 3C:
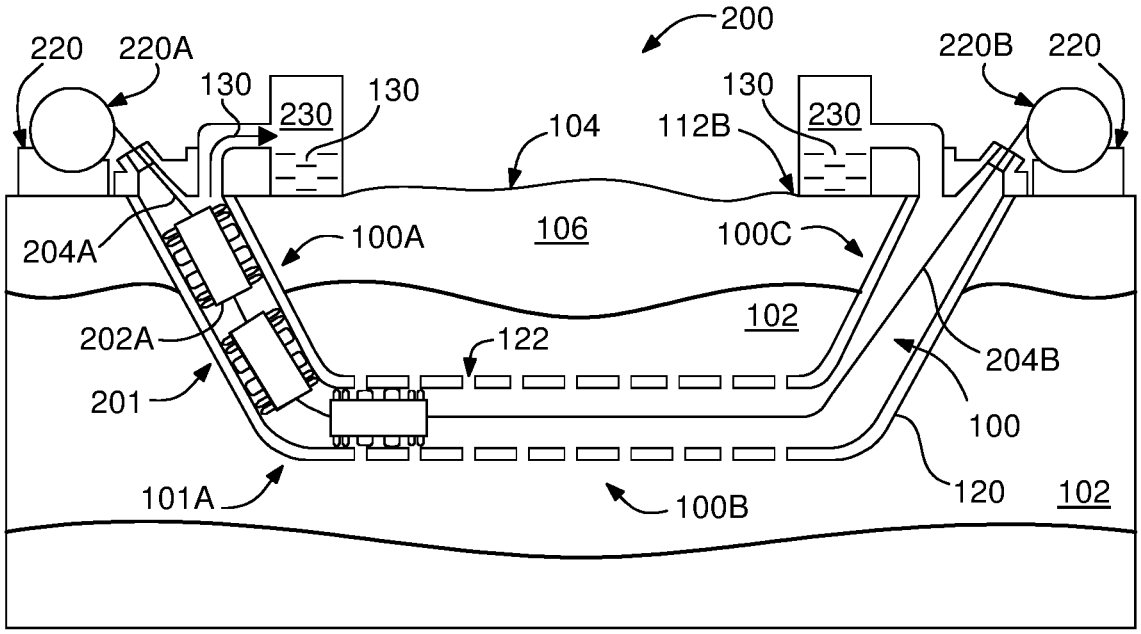

FIGS. 3A-3C show an embodiment of an exemplary system 200 of the present invention for thermal treatment and recovery of the hydrocarbon materials from the subterranean formation 102 or subsurface reservoir accessed by the wellbore 100 of the present invention. The system 200 may be operated by employing an operation sequence including a thermal treatment stage to obtain a low viscosity hydrocarbon material which flows into the second wellbore section 100B, and a recovery stage to recover the low viscosity hydrocarbon material collected within the second wellbore section 100B, and lifting or transporting it to the surface 104. At the thermal treatment stage, the system 200 of the present invention may be configured to apply heat to the high viscosity hydrocarbon material contained in the subterranean formation 102 to reduce its viscosity, which viscosity reduction results in increasing the mobility of the hydrocarbon material. The system 200 of the present invention may be configured to mechanically lift the low viscosity hydrocarbon material, collected within the wellbore 100, to the surface 104 by a sweeping action.

As shown in FIG. 3A, the system 200 may comprise a heater-lifter module 201 which may include one or more heater-lifter units 202, or heater-sweeper units, for example a first, a second and a third heater unit 202A, 202B and 202C respectively. The heater-lifter units 202 may be disposed within the second wellbore section 100B including the perforations 122. Once disposed within second wellbore section 100B, during the thermal treatment stage, the heater-lifter units 202 may generate heat and transfer this heat to the adjacent subterranean formation through the casing 120 which may or may not be in physical contact with the heater-lifter units 202. With the applied heat, hydrocarbon material is mobilized and flows into the second wellbore section 100B by flowing through the perforations 122, and kept in a low viscosity or fluid-like state with the heat from heater-lifter units 202A, 202B and 202C of the heater-lifter module 201. During the thermal treatment stage, temperature of the hydrocarbon material within the heat applied region surrounding the heater-lifter units 202 may reach a temperature range of about 150° C.-250° C., preferably about 190° C.-210° C. The thermal treatment at these temperature ranges may reduce the viscosity of the hydrocarbon material down to about 10 cP-50 cP, preferably about 10 cP-20 cP, which makes the hydrocarbon material flow.

A carrier line 204 or cable of the system 200 may support the heater-lifter module 201 within the wellbore 100 and connects the heater-lifter module 201 to a lifting mechanism 220 configured to move the heater-lifter module by moving the carrier line 204. As will be described more fully below, the low viscosity hydrocarbon material collected in the second wellbore section 100B may be recovered by moving the heater-lifter module 201 towards the entry opening 110A or the exit opening 110B of the wellbore 100. As the heater-lifter module 201 is moved by the lifting mechanism 220, the low viscosity hydrocarbon material may be swept along the moving direction of the heater-lifter module 201, either towards the entry opening 110A or the exit opening 110B, and swept out of the wellbore 100 to be stored in storage tanks 230 of the system 200.

The carrier line 204 may connect the heater-lifter units 202 to one another, for example, the first heater unit 202A to the second heater-lifter unit 202B and the second heater-lifter unit 202B to the third heater-lifter unit 202C. A first portion 204A of the carrier line 204 may extend through the elbow section 101A and the first wellbore section 100A and exits the wellbore 100 through the entry opening 110A at the entry location 112A. The first portion 204A of the carrier line 204 may connect the first heater-lifter unit 202A to a first spool 220A of the lifting mechanism 220 at the entry location 112A. Similarly a second portion 204B of the carrier line 204 may extend through the elbow section 101B and the third wellbore section 100C and exits the wellbore through the exit opening 110B of the wellbore 100 at the exit location 112B. The second portion 204B of the carrier line 204 may connect the third heater-lifter unit 202A to a second spool 220B of the lifting mechanism 220 at the exit location 112B. The heater-lifter units 202 of the heater-lifter module 201 may be spaced apart from one another by a predetermined distance. The lifting mechanism 220 may include motors, generators, power sources, control systems, mechanical and electrical assemblies to rotate and control the operation of the first spool 220A and the second spool 220B and hence the movement of the carrier line 204.

FIGS. 3B and 3C show an exemplary recovery stage of the low viscosity hydrocarbons mobilized and collected during the previous thermal treatment stage. Referring to FIG. 3B, the low viscosity hydrocarbon material, having about 10 cP-20 cP viscosity, which will be called as hydrocarbon fluid 130 hereinbelow, collected in the second wellbore section 100B may be swept toward the exit location 112B by moving the heater-lifter module 201 toward the exit location 112B. In order to move the heater-lifter module 201 toward the exist location 112B, the moving mechanism 220 may rotate the second spool 220B to coil the second portion 204B of the carrier line 204 while also rotating the first spool 220A to uncoil the first portion 204A. The sweeping action created by the movement of the heater-lifter module 201 may mechanically lift the hydrocarbon fluid 130 to the surface and direct into the storage tank 230 via the elbow section 101B and the third wellbore section 100C. After this step, the lifting mechanism 220 may retract the heater-lifter module 201 into the second wellbore section 100B by uncoiling the second portion 204B and coiling the first portion 204A of the carrier line 204 for further thermal treatment and resulting hydrocarbon fluid production, as exemplified above with respect to FIG. 3A.

Referring to FIG. 3C, the hydrocarbon fluid 130 collected in the second wellbore section 100B may be, this time, swept in the direction toward the entry location 112A by moving the heater-lifter module 201 toward the entry location 112A. In order to move the heater-lifter module 201 toward the entry location 112A, the lifting mechanism 220 may rotate the first spool 220A to coil the first portion 204A of the carrier line 204 while also rotating the second spool 220B to uncoil the second portion 204B. The sweeping action created by the movement of the heater-lifter module 201 may mechanically lift the hydrocarbon fluid 130 to the surface and direct into the storage tank 230 via the elbow section 101A and the first wellbore section 100A. After this step, again, the lifting mechanism 220 may retract the heater-lifter module 201 into the second wellbore section 100B for more thermal treatment, but this time, by uncoiling the first portion 204A and coiling the first portion 204B of the carrier line 204. The process may continue by repeating the previous steps to recover more hydrocarbon material by moving the heater-lifter module 201 in bidirectional manner to mechanically lift more hydrocarbon fluid 130 to the entry and the exit locations 112A and 112B at the surface. In one embodiment, during mechanical lifting of the hydrocarbon fluid 130, the heater-lifter module 201 may be turned off so as not to generate heat at this stage. In the above embodiments, although the first and third wellbore sections 100A and 100C are shown slanted wellbore sections, depending on the size, shape, depth of the subsurface reservoir, the first and second wellbore section may alternatively be made vertical, and this feature is also within the scope of this invention.

Figure 4A:
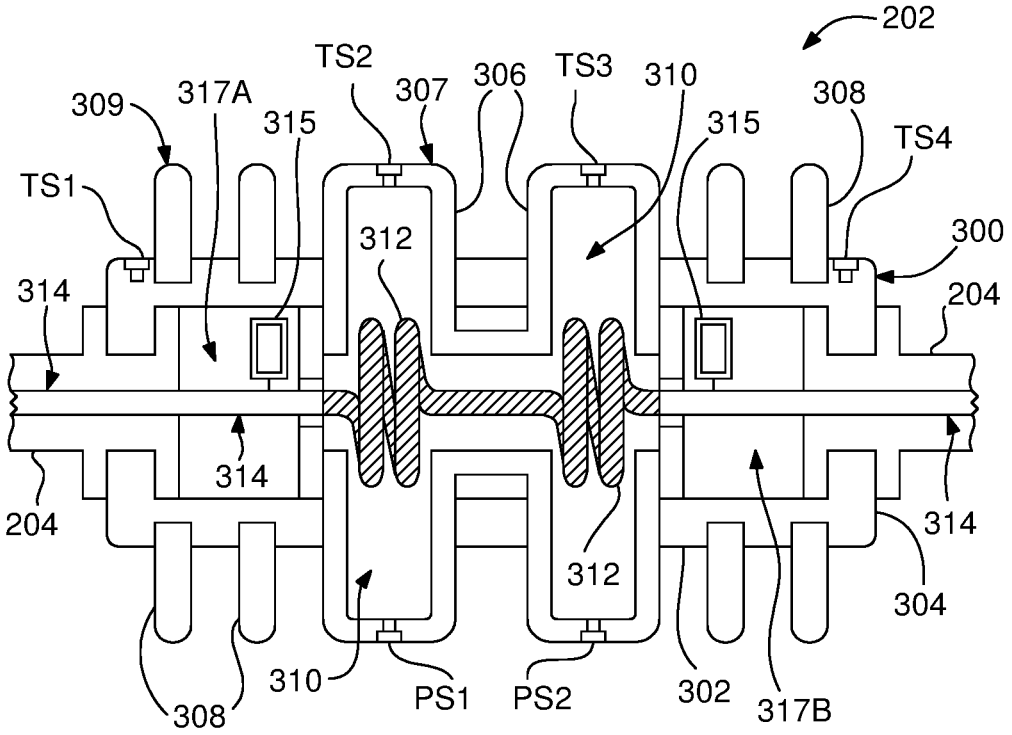
FIG. 4A is a schematic view of an embodiment of a single heater-lifter unit of the heater-lifter module.
Figure 4B:
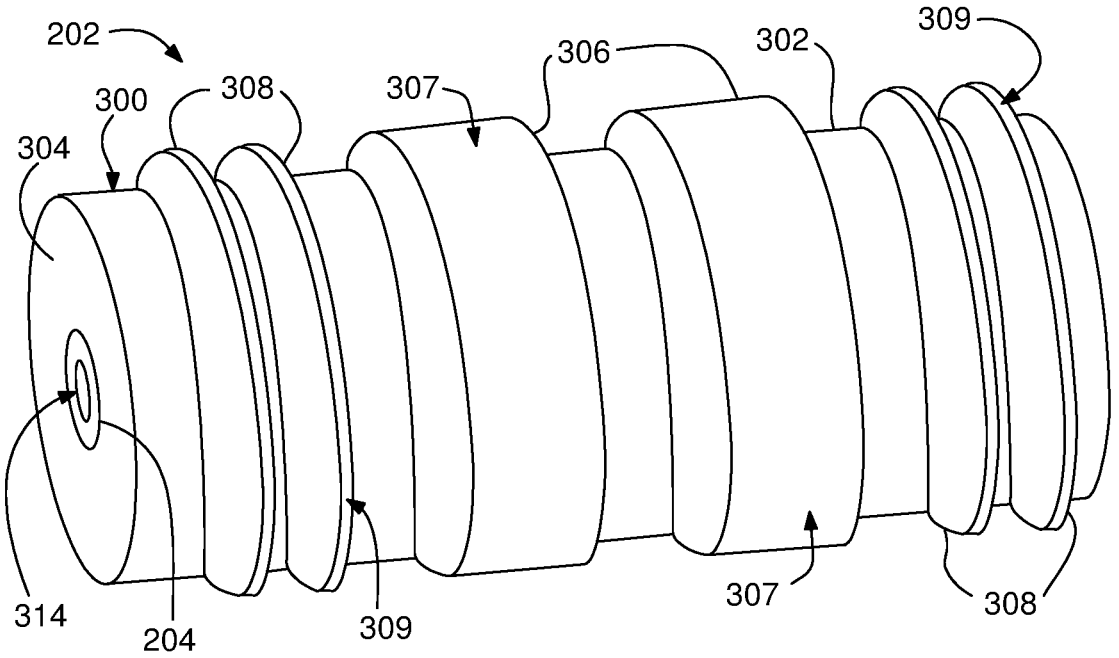
FIG. 4B is a schematic perspective view of the heater-lifter unit shown in FIG. 4A.

FIGS. 4A and 4B show an embodiment of an exemplary heater-lifter unit 202 of the system 200. The heater-lifter unit 202 may include a heater-lifter housing 300, having generally an elongated cylindrical shape, with a peripheral wall 302 and side walls 304. The peripheral wall 302 of the housing 300 may be substantially cylindrical, and the side walls 304 may be disk shaped. In order to increase mechanical lifting capacity of the heater-lifter units, the side walls 304 may be cup shaped or concave shaped with curved part extending into housing 300. One or more heating members 306 and one or more sweeping members 308 may outwardly protrude from the peripheral wall 302 and symmetrically distributed along the horizontal axis of the heater-lifter housing 300. The heating members 306 may transfer heat from the heater-lifter unit 202 to both the subterranean formation 102 through the casing 120 and the hydrocarbon fluid 130 collected within the second wellbore section 100B during the thermal treatment stage. Heat may be transferred to the perforated casing or the environment by physical contact of top surfaces 307 of heating members 306 or by radiation from the exposed surfaces of the heating members 306. The heating members 306 may generally have a reversed U shape cross-section.

The sweeping members 308 may sweep the hydrocarbon fluid 130 toward the exit and entry locations 112A and 112B as the heater-lifter unit 202 is moved during the recovery stage. The sweeping members 308 may have a blade-like cross-section. The heating members 306 and the sweeping members 308 may radially and continuously extend from the outer surface of the cylindrical peripheral wall 302, and thereby both may be circular or ring shaped. On the peripheral wall 302, the sweeping members 308 may be generally located adjacent the side walls 304 and may be grouped near both ends of the substantially cylindrical peripheral wall 302 of the heater-lifter housing 300 in a symmetrical fashion. The combination of side walls 304 and the sweeping members 308 surrounding the side walls at the ends of the heater-lifter housing 300 may advantageously function as a plunger when moved along the inner cylindrical surface of the wellbore 100 to lift the collected hydrocarbon fluid 130 to the surface of the ground. The heating members 306 may be disposed over the peripheral wall portion located between the sweeping members 308 and symmetrically distributed thereon. The heating members 306 may be evenly distanced apart from one another to effectively transfer heat to the perforated casing and hence the surrounding subterranean formation 102 containing the hydrocarbon material.

The heating members 306 may be an integral part of a heating chamber 310 including one or more heating elements 312 disposed within the heating chamber to generate the heat or radiation that heats the heating members 306 contacting the casing 120. The heating elements 312 may be electrical resistors or resistance wires made of ceramics or metal alloys, such as Ni—Cr alloys, Kanthal™, Constantan, Manganin and the like. The heating elements 312 receive electrical power through a power-data cable 314 extended through the carrier line 204 secured to the side walls 304 of the heater-lifter housings 300. The power-data cable 314 may be connected to a power-data center, probably a mobile power-data center (not shown), on the surface 104. Each heater-lifter unit 202 may include temperature sensors TS, pressure sensors PS and one or more control circuitry 315 to monitor and control the operation of each heater-lifter unit 202 via the power-data line 314 from the power-data center (not shown). The temperature sensors TS, such as TS1, TS2, TS3 and TS4, and pressure sensors PS, such as PS1 and PS2, may be disposed on the exposed surfaces of the heater-lifter housing 300, such as on the top surfaces 307 of heating members 306 and on the peripheral wall 302 of the heater-lifter housing 300. Both the temperature sensors TS and the pressure sensors PS may be connected to the control circuitries 315 disposed within a first chamber 317A and a second chamber 317B of the heater-lifter housing 300. The first and second chambers 317A and 317B may be filled with heavy oil for thermal insulation for the circuitries 315. The carrier line 204 may be a flexible line which may be made of a high strength flexible stainless steel mesh tubing insulated with abrasion and corrosion resistant flexible polymers.

The heating members 306 and optionally the entire heating chamber 310 may be made of high thermal conductivity materials such copper alloys, aluminum alloys or the like. In one embodiment, the diameter of the circular top surface 307 of each heating member 306 (heating member diameter) may be made slightly less than the inner diameter of the casing 120 to facilitate the movement of the heater-lifter units 202 within the wellbore 100 with minimum friction. For example, the heating member diameter may be made about 2 cm to 6 cm, preferably about 2.5 cm to 4 cm, less than the inner diameter of the casing 120. The sweeping members 308 may be made of flexible, heat and chemical corrosion resistant materials, such as flexible polymers or rubbers which may withstand the operation temperatures within the wellbore 100 or composites such as flexible polymers reinforced with flexible steel meshes or flexible stainless steel meshes. The flexibility property of the sweeping members 308 may enable them to efficiently sweep the hydrocarbon fluid along the inner surface of the casing tube 120 while reducing the friction thereon as the heater-lifter units 202 are moved toward the surface during the recovery stage. In this respect, in order to increase the sweeping efficiency, the diameter of top ends 309 of the sweeping members 308 (sweeping member diameter) may be made equal to or greater than the inner diameter of the casing 120. For example, the sweeping member diameter may be made about 0 cm-5 cm, preferably about 2 cm-4 cm greater than the inner diameter of the casing 120. In other words, the height of sweeping members 308 is greater than the height of heating members 306 when their height measured from the outer cylindrical surface of the peripheral wall 302 to the top ends 309 of the sweeping members 308 and to the top surface 307 of the heating members 306. In one embodiment, the diameter of the outer cylindrical surface of the peripheral wall 302 (heater-lifter housing diameter) of the heater-lifter housing 300 may be made about 2 cm-8 cm less than the inner diameter of the casing 120. An exemplary length for heater-lifter housing 300 may be in the range of about 2-20 m, preferably about 8-10 m.

As an example, for a casing having 7 inches (17.8 cm) outer diameter and 6⅛ inches (15.55 cm) inner diameter, a heater-lifter unit may have a heating member diameter of about 13.5 cm-14.5 cm, or 13.5 cm-15.55 cm, a sweeping member diameter of about 15.5 cm-18 cm, a heater-lifter housing diameter of about 10 cm-13 cm, and a heater-lifter housing length of about 800 cm-1000 cm.

Figure 5A:
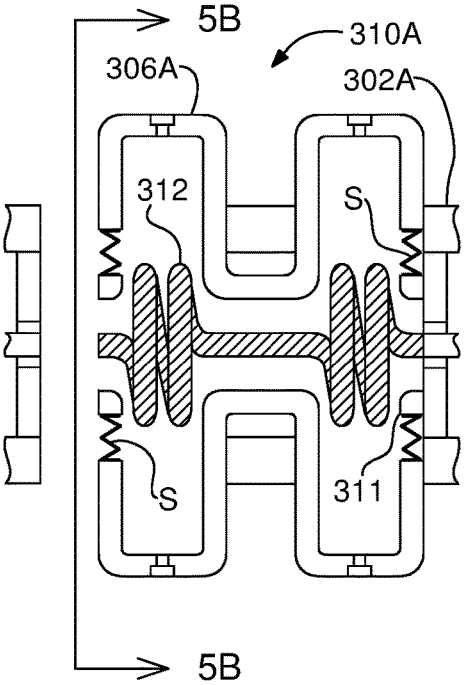
FIGS. 5A-5B are schematic views of an embodiment of a heater-lifter unit having compressible heating members.
Figure 5B:
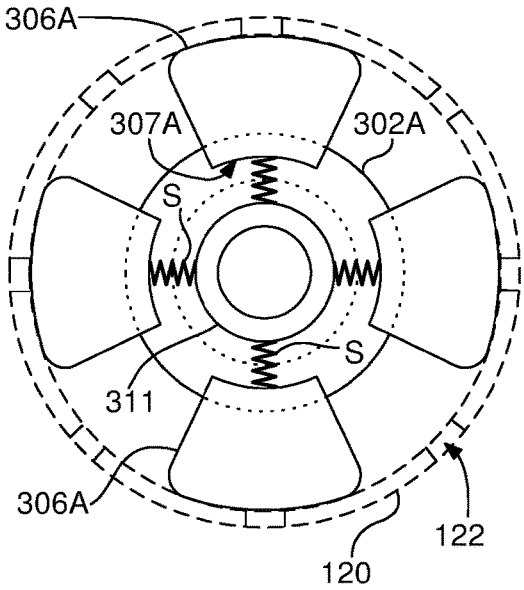
Figure 6:
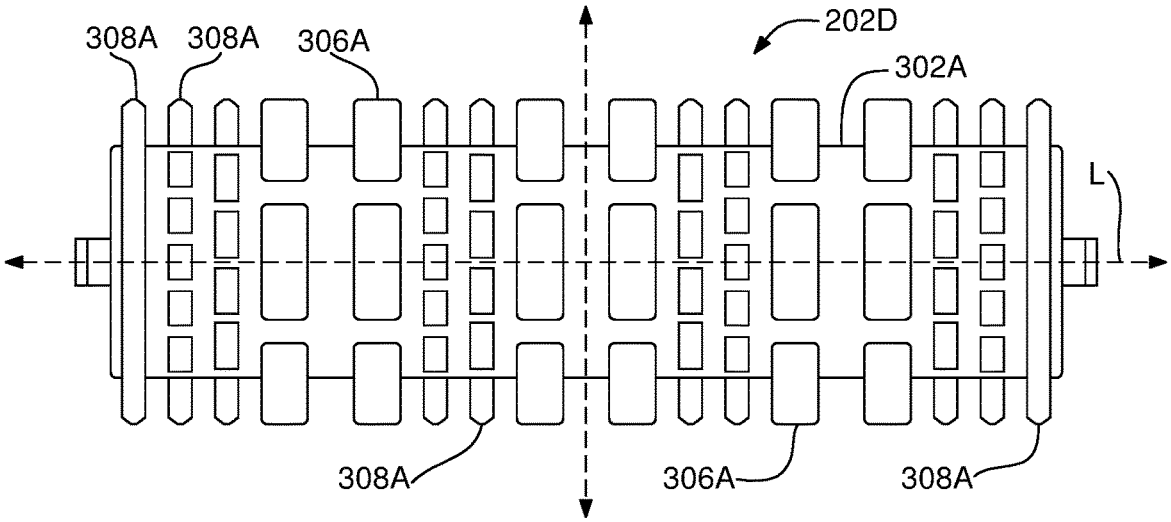
FIG. 6 is a is a schematic perspective view of an embodiment of a heater-lifter unit.

FIGS. 5A-5B show an embodiment of a heating chamber 310A which may be used with the heater-lifter unit 202 or other heater lifter units such as the heater-lifter unit 202D shown in FIG. 6. Differing from the previously described heating chamber 310 shown in for example in FIGS. 4A-4B, the heating chamber 310A may include heating members 306A movably protruding from the peripheral wall 302A of the heater-lifter unit 202D. In one embodiment, the heating members 306A of the heating chamber 310A may include multiple independent heating members distributed symmetrically and radially around the longitudinal axis L of the heater-lifter unit 202D. The heating members 306A may be compressible or radially compressible, which feature allows the heater-lifter unit 202D to vary its outer diameter within the casing 120 and also allows heating members 306A to establish full contact with the inner surface of the casing 120 to transfer heat, thereby further increasing the efficiency of the thermal process.

In one embodiment, one or more springs S located at both ends of the heating chamber 310A may provide compressibility to the heating members 306A. Springs S may be disposed between a base ring 311 of the heating chamber 310A and lower ends 307A of the heating members 306A. The springs S may allow heating members 306A to move between a rest state (fully extended) when there is no force on them, and a compressed state when there is a force applied on them. As shown in FIG. 5B, in one embodiment, the exemplary heating chamber 310A may include four sets of heating members 306A which may be distributed radially. In their rest state (no force on the heating members), the springs S may keep the heating members 306A at their fully extended state (no compression). When the heating members 306A are in fully extended state, the outer diameter of the heater-lifter unit 202D may be equal to the inner diameter of the casing 120. In this extended state all of the heating members 306A may physically contact the casing 120 and efficiently transfer the heat from the heating elements 302 to the casing and the surrounding hydrocarbon material. The compressible nature of the heating members 306A may enable the heater-lifter unit 202D to move easily within the wellbore 100, pass through the tighter portions of the wellbore 100, and also slip through the wellbore portions having obstacles or blocking material. The heating members 306A may be compressed individually (locally) to slip through an obstacle, or all together, especially, when passing through a wellbore having tighter dimensions. The compressible nature of the heating members 306A may further increase the heater-lifter unit's usage versatility by allowing the same heater-lifter unit to be used in various diameter wellbores for multiple operations. By changing the properties of the springs force required for the compression and rest stages may be adjusted.

As shown in FIG. 6, the heater-lifter unit 202D may include a plurality of heating members 306A and sweeping members 308A distributed radially and symmetrically over the peripheral wall 302A of the heater-lifter unit 202D. In this embodiment, the sweeping members 308A may be comprised of multiple pieces which may be radially distributed. However, the sweeping members 308A located at both ends of the heater-lifter unit 202D may be circular so as to efficiently sweep the hydrocarbon fluid.

Figure 7:
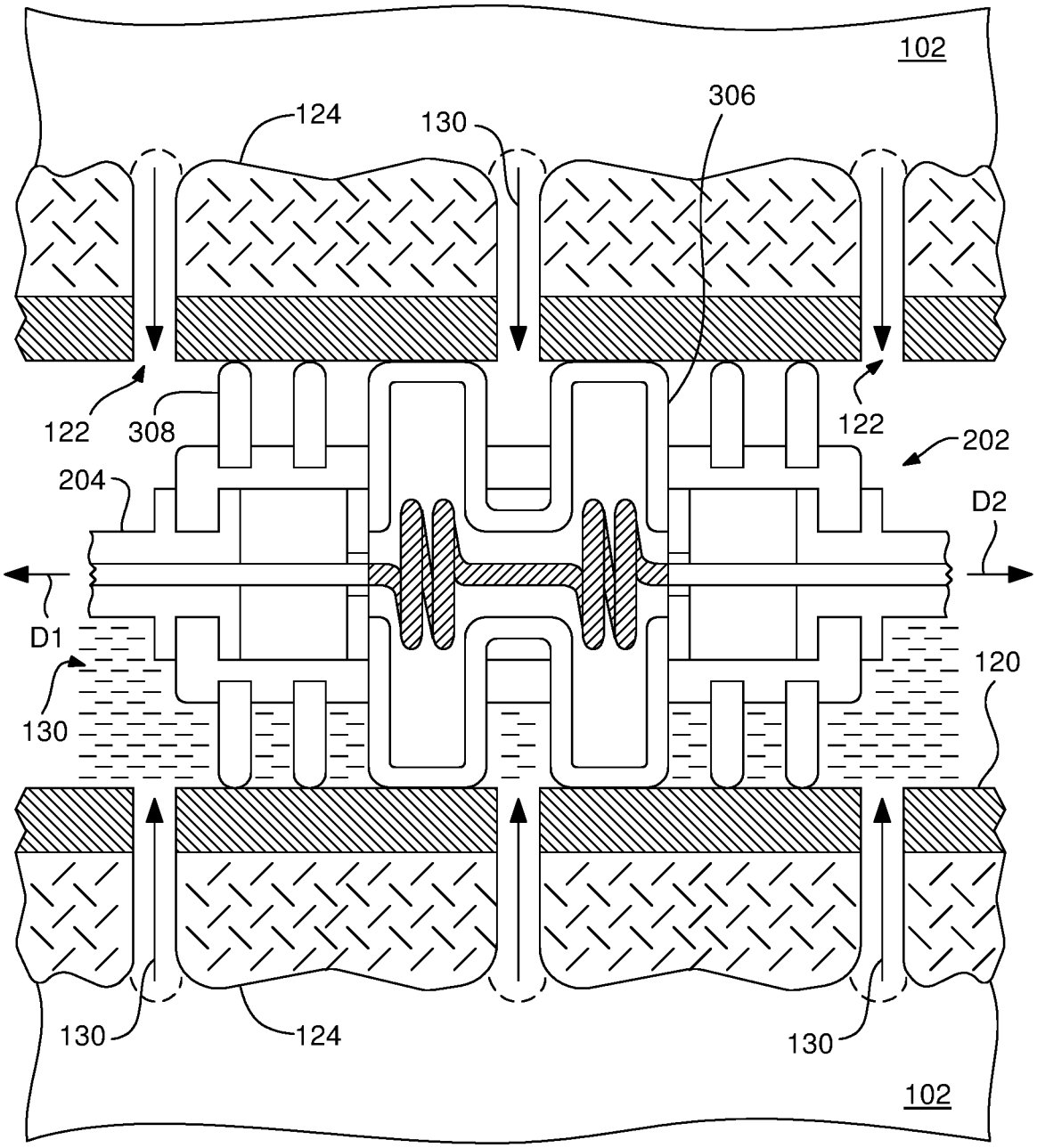
FIG. 7 is a schematic view of the heater-lifter unit disposed within a portion of the continuous wellbore for the thermal treatment of the surrounding hydrocarbons.

FIG. 7 illustrates the heater-lifter unit 202 disposed in a portion of the second wellbore section 100B during the thermal treatment stage of the operation. Perforations 122 extend to the subterranean formation 102 through both the casing 120 and cement layer 124. Heat from the heating members 306 heats the casing 120, the cement layer 124 and transfers to the subterranean formation 102 including the hydrocarbon material, such as bitumen. As the hydrocarbon material's viscosity is reduced, the hydrocarbon fluid 130 flows into the second wellbore section 100B. During the subsequent recovery stage, the warm hydrocarbon fluid, such as low viscosity bitumen, filling the second wellbore section 100B may be mechanically lifted up to the surface by the movement of the heater-lifter units 202 in a first direction D1 and a second direction D2.

In another embodiment of the present invention, at least one pressured gas supply assembly configured to supply pressured gas into the continuous wellbore from either the first surface location or the second surface location to treat the subterranean hydrocarbon formation surrounding the substantially horizontal wellbore section with pressured gas to produce hydrocarbon fluids. The hydrocarbon fluids produced or mobilized by gas treatment may be swept by the pressured gas flow in the direction of the pressured gas flow toward the selected surface location and get stored.

Figure 8A:
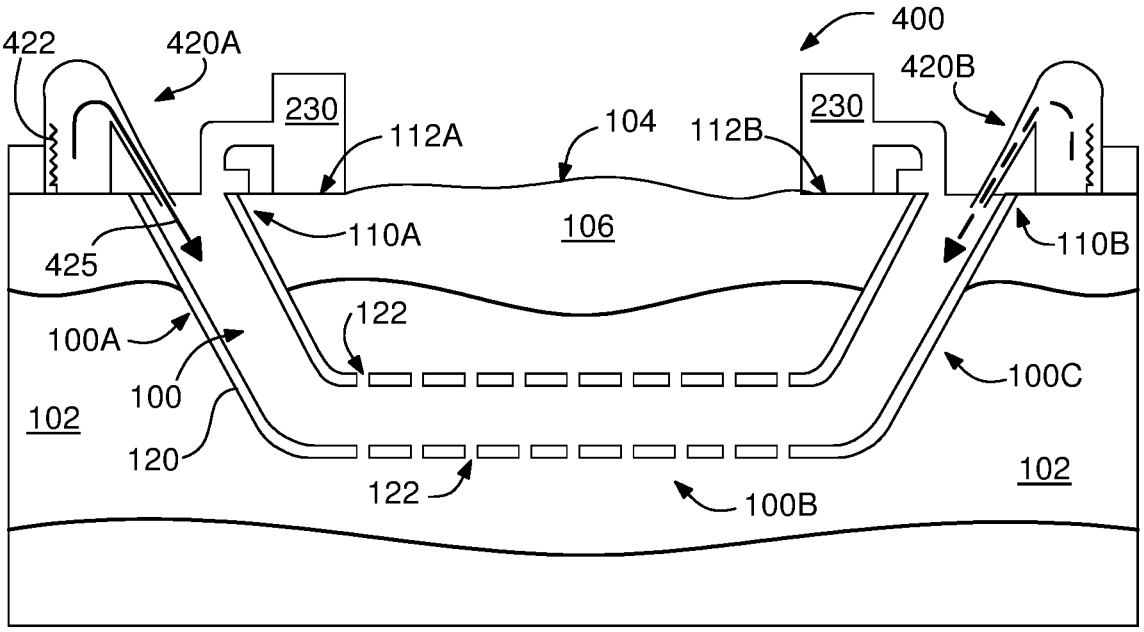
FIGS. 8A-8B are schematic views of an embodiment of a system of the present invention including a pressured gas assembly providing pressured gas into the continuous wellbore for mobilizing hydrocarbons in the subsurface hydrocarbon reservoir.
Figure 8B:
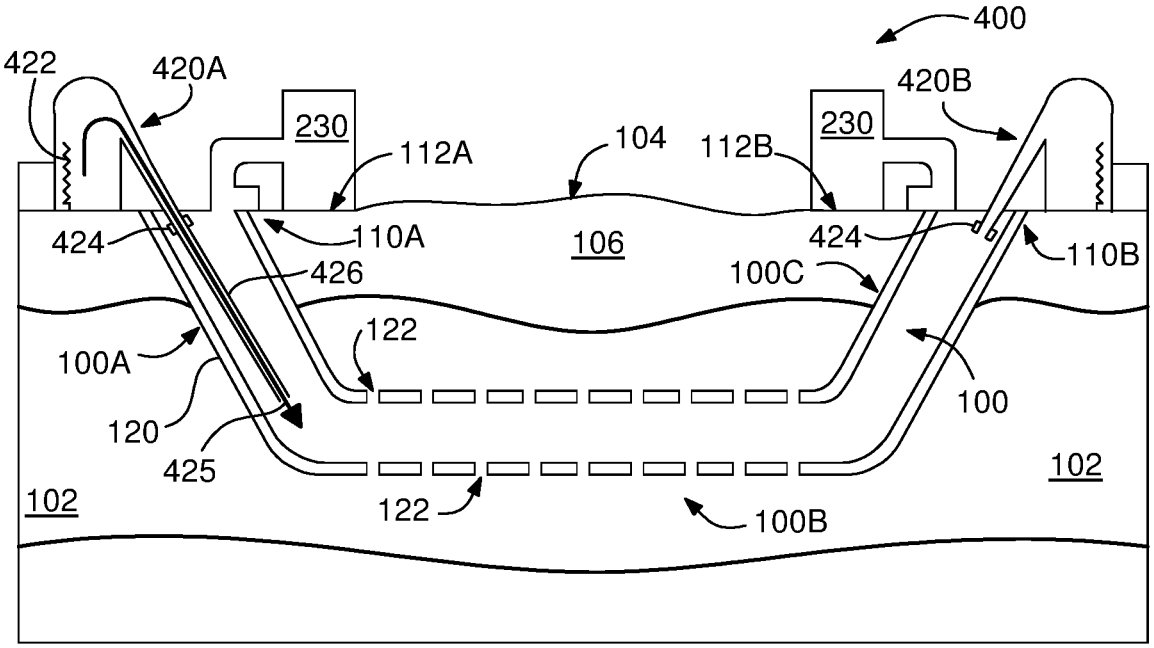

FIGS. 8A-8B show an embodiment of an exemplary system 400 of the present invention for gas treatment and recovery of the hydrocarbon material from the subterranean hydrocarbon formation 102 or subsurface reservoir accessed with the wellbore 100. The gas treatment stage of this embodiment may employ gas injection or miscible flooding approach to displace hydrocarbon material in the subterranean formation by saturating it with a gas. The gas may be a miscible gas which may acts as a solvent and dissolve the hydrocarbon material thereby reducing the viscosity of the hydrocarbon material. For such miscible flooding, exemplary miscible gases may be carbon dioxide ($CO_2$), nitrogen ($N_2$) and natural gas or hydrocarbon gas. The system 400 may be configured to employ at least one miscible gas supply to inject a miscible gas or a miscible gas mixture into the wellbore 100 for reducing the viscosity of the hydrocarbon material and lifting or transport it to the surface 104.

As shown in FIG. 8A-8B, the system 400 may comprise a gas supply assembly 420 which may include a first gas supply unit 420A and a second gas supply unit 420B to introduce a gas into the wellbore from the surface. In one embodiment, the gas may be natural gas including a methane content of about 99% or greater than 99%. The gas supply units 420A and 420B may include gas pumps and compressors, and, optionally, gas heaters 422 to heat the supplied gas when gas heating is needed. The gas supply units 420A and 420B may be capable of increasing the pressure of the gas delivered into wellbore 100 to create a pressured gas flow which may be delivered to the wellbore 100 in a cyclic or continuous fashion. An exemplary gas pressure range may be about 500-600 psi. The first gas supply unit 420A may be located at the entry location 112A and adjacent the entry opening 110A, and the second gas supply unit 420B may be located at the exit location 112A and adjacent the exit opening 110A of the wellbore 100. Gas may be delivered through nozzles 424 of the gas supply units 420A, 420B disposed into the entry opening 110A and the exit opening 110B. As shown in FIG. 8B, in one embodiment, a pipe 426 may be extended near the second wellbore section 100B and attached to the nozzle 424 to directly deliver the pressured gas into the perforated second wellbore section 100B of the wellbore 100.

In one embodiment, in operation, only one of the gas supply units 420A and 420B may be used for the gas treatment and the recovery of the hydrocarbon material. For example, in one exemplary operation, a pressured gas flow 425 from the first gas supply unit 420A may be flowed through the wellbore 100. As the pressured gas flow 425 moves through the second wellbore section 100B which includes the perforations 122, the gas may interact with the hydrocarbon material through the perforations 122, causing the resulting viscosity reduction. As the gas dissolves in the hydrocarbon material, i.e., bitumen, the hydrocarbon material may be swelled and the viscosity of the hydrocarbon material lowered. The low viscosity hydrocarbon material or hydrocarbon fluid getting collected in the second wellbore section 100B may be continuously swept by the incoming pressured gas flow 425, in the direction of the gas flow, toward the exit opening 110B and collected in the storage 230 at the exit location 112B. The same operation may be performed using a pressured gas flow from the second gas supply unit 420B and the hydrocarbon fluid can be stored at the entry location 112A. The pressured gas flow 425 may optionally be heated to accelerate the mobilization of the hydrocarbon materials. The pressured gas supply assembly 420 may alternatively be an integral part of the system 200 described above. In such case, both gas supply units 420A and 420B may be used to supply a pressured gas flow or a heated pressured gas flow in the same direction as the direction of motion of the heater-lifter unit shown for example in FIGS. 3A-3C during the thermal treatment and recovery stages.

Figure 9:
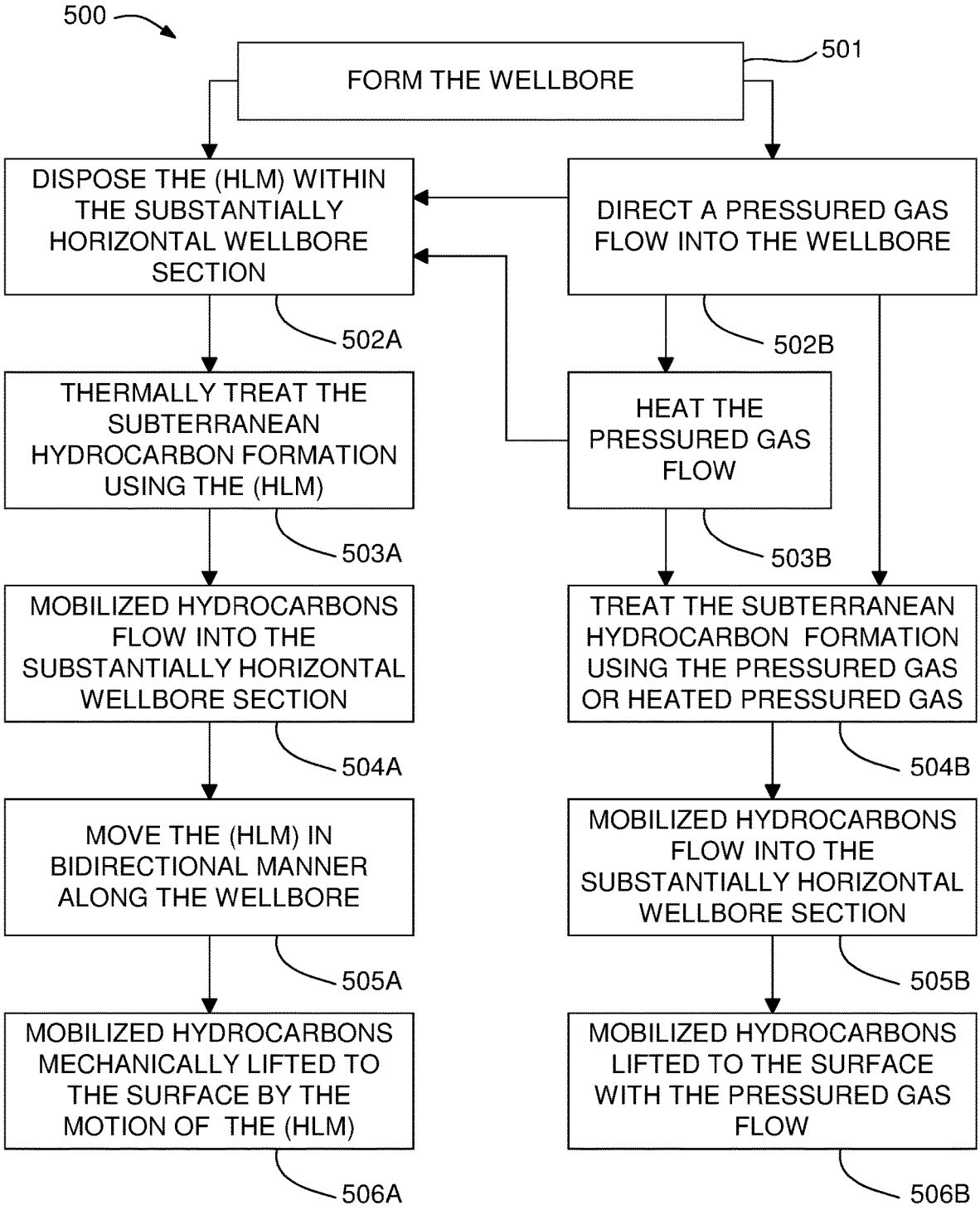
FIG. 9 is a diagram showing methods of the present invention.

FIG. 9 shows a flow chart 500 describing exemplary process embodiments of treatment and recovery of hydrocarbon materials. Accordingly, at step 501, the wellbore 100 accessing the subterranean hydrocarbon formation may be drilled or formed. At next step, depending on the system used the process may proceed with the following. At step 502A, using the system 200 described above in FIGS. 3A-3C, the heater-lifter module (HLM) 202 may be movably disposed within the substantially horizontal wellbore section 100B. Using the HLM 202, the subterranean hydrocarbon formation may be thermally treated at step 503A, which may result in the mobilized hydrocarbon flow into the substantially horizontal wellbore section 100B at step 504A. Next, at step 505A, the HLM 202 may be moved in bidirectional manner along the continuous wellbore 100, which results in the lifting of the mobilized hydrocarbons to the surface at step 506A.

At step 502B, this time, using the system 400 described in FIGS. 8A-8B, the pressured gas flow 425 may be delivered into the wellbore 100 by employing the pressured gas supply assembly 420. The pressured gas flow may optionally be heated at step 503B. The gas supply assembly 420 may alternatively be an integral part of the system 200 as mentioned above. In such case, the gas supply assembly 420 may be used to supply the pressured gas flow or a heated pressured gas flow for the system 200 shown in FIGS. 3A-3C, as explained above. At step 504B, the subterranean hydrocarbon formation may be treated with the pressured gas flow, which may result in the mobilized hydrocarbon flow into the substantially horizontal wellbore section 100B at step 505B. Finally, at step 506B, the mobilized hydrocarbons may be simultaneously lifted to the surface.

Although aspects and advantages of the present invention are described herein with respect to certain preferred embodiments, modifications of the preferred embodiments will be apparent to those skilled in the art. Thus the scope of the present invention should not be limited to the foregoing discussion, but should be defined by the appended claims.

I claim:

1. A system for recovering hydrocarbons from a subsurface reservoir, comprising:

a continuous wellbore extending from a first surface location to a second surface location, the continuous wellbore including a first inclined wellbore section extending from the first surface location to the subsurface reservoir, a substantially horizontal wellbore section lying within the subsurface reservoir, and a second inclined wellbore section extending from the subsurface reservoir to the second surface location;

one or more heater-lifter units disposed within the substantially horizontal wellbore section, the one or more heater-lifter units being configured to apply heat to the subsurface reservoir to produce hydrocarbon fluids;

a lifting mechanism configured to move the one or more heater-lifter units in bidirectional manner in the continuous wellbore to mechanically lift the hydrocarbon fluids to the first surface location and the second surface location by sweeping the hydrocarbon fluids through the continuous wellbore with the one or more heater-lifter units; and a pressured gas assembly configured to supply a flow of pressured gas into the continuous wellbore from the first surface location and the second surface location.

2. The system of claim 1, wherein the continuous wellbore includes a casing extending therein, the casing having perforations in the substantially horizontal wellbore section.

3. The system of claim 2, wherein the pressured gas is applied to the subsurface reservoir surrounding the substantially horizontal wellbore section to further produce the hydrocarbon fluids by interacting with the hydrocarbons in the subsurface reservoir.

4. The system of claim 3, wherein the flow of pressured gas supplied in a cyclic fashion from the first surface location and the second surface location in the same direction as the direction of motion of the one or more heater-lifter units as the one or more heater-lifter units are moved in bidirectional manner in the continuous wellbore to mechanically lift the hydrocarbon fluids to the first surface location and the second surface location.

5. The system of claim 1, wherein the pressured gas assembly comprises a first gas tank and a first pump located at the first surface location and a second gas tank and a second pump located at the second surface location to supply the flow of pressured gas into the continuous wellbore.

6. The system of claim 1, wherein the pressured gas assembly comprises a first heater at the first surface location and a second heater at the second surface location to heat the flow of pressured gas.

7. The system of claim 1, wherein the flow of pressured gas includes natural gas having a methane content of about 99%.

8. The system of claim 1 further comprising a carrier line carrying the one more heater-lifter units, the carrier line extending through the continuous wellbore and between the first and the second surface locations.

9. The system of claim 8, wherein the lifting mechanism is configured to move the carrier line and thus the one or more heater-lifter units coupled to the carrier line in bidirectional manner.

10. The system of claim 9, wherein the carrier line includes a flexible cable having a steel wire reinforced outer portion capable of carrying the load including the weight of the one or more heater-lifter units and the weight of the hydrocarbon fluids lifted, the flexible cable further including an inner portion including insulated power and data lines in communication with a ground surface power and control center.

11. The system of claim 9, wherein the lifting mechanism includes a first spool at the first surface location and a second spool at the second surface location, the first spool and the second spool are operatively connected to a first end and a second end of the carrier line respectively.

12. The system of claim 11, wherein the first spool is adapted to coil the carrier line to mechanically lift the hydrocarbon fluids to the first surface location by moving the one or more heater-lifter units towards the first surface location, and wherein the second spool is adapted to coil the carrier line to mechanically lift the hydrocarbon fluids to the second surface location by moving the one or more heater-lifter units towards the second surface location.

13. The system of claim 1, wherein a plurality of heating members protrude outwardly from each of the one or more heater-lifter units, the heating members being configured to heat the subsurface reservoir to produce the hydrocarbon fluids, and wherein a plurality of flexible sweeping members protrude outwardly from the each of the one or more heater-lifter units, the flexible sweeping members being configured to sweep the hydrocarbon fluids along the direction of motion of the one or more heater-lifter units.

14. The system of claim 1, wherein the subsurface reservoir is sand tar reservoir including bitumen hydrocarbon.

15. A method for recovering hydrocarbons from a subsurface hydrocarbon reservoir, comprising:

forming a continuous wellbore extending from a first surface location to a second surface location, the continuous wellbore including a first inclined wellbore section extending from the first surface location to the subsurface hydrocarbon reservoir, a substantially horizontal wellbore section lying within the subsurface hydrocarbon reservoir, and a second inclined wellbore section extending from the subsurface hydrocarbon reservoir to the second surface location;

applying heat to the subsurface hydrocarbon reservoir surrounding the substantially horizontal wellbore section from one or more heater-lifter units movably disposed within the substantially horizontal wellbore section;

applying a flow of pressured gas to the subsurface hydrocarbon reservoir surrounding the substantially horizontal wellbore section;

producing hydrocarbon fluids flowing into the substantially horizontal wellbore section from the subsurface hydrocarbon reservoir; and moving the one or more heater-lifter units in bidirectional manner within the continuous wellbore to mechanically lift the hydrocarbon fluids to the first surface location and the second surface location by sweeping the hydrocarbons fluids with bidirectional motion of the one or more heater-lifter units.

16. The method of claim 15 further comprising forming a casing through the continuous wellbore from the first surface location to the second surface location, wherein a portion of the casing extending through the substantially horizontal wellbore section includes perforations exposing the subsurface hydrocarbon reservoir surrounding the substantially horizontal wellbore section.

17. The method of claim 16, wherein moving the one or more heater-lifter units includes moving a carrier line carrying the one or more heater-lifter units, the carrier line is moved by a lifting mechanism including a first spool at the first surface location and a second spool at the second surface location, the first spool and the second spool are operatively connected to a first end and a second end of the carrier line respectively.

18. The method of claim 15, wherein the flow of pressured gas supplied in a cyclic fashion from the first surface location and the second surface location in the same direction as the direction of motion of the one or more heater-lifter units as the one or more heater-lifter units are moved in bidirectional manner in the continuous wellbore to mechanically lift the hydrocarbon fluids to the first surface location and the second surface location.

19. The method of claim 18, wherein the flow of pressured gas is supplied from a pressured gas assembly comprising a first gas tank and a first pump located at the first surface location and a second gas tank and a second pump located at the second surface location to supply the flow of pressured gas into the continuous wellbore.

20. The method of claim 19 further comprising heating the flow pressured gas using first heater at the first surface location and a second heater at the second surface location.

* * * * *